US009748666B2

(12) United States Patent
Daurer et al.

(10) Patent No.: US 9,748,666 B2
(45) Date of Patent: Aug. 29, 2017

(54) BROADBAND OMNIDIRECTIONAL ANTENNA

(71) Applicant: KATHREIN-WERKE KG, Rosenheim (DE)

(72) Inventors: Claudia Daurer, Stephanskirchen (DE); Manfred Stolle, Bad Aibling (DE)

(73) Assignee: Kathrein-Werke AG, Rosenheim (DE)

( * ) Notice: Subject to any disclaimer, the term of this patent is extended or adjusted under 35 U.S.C. 154(b) by 99 days.

(21) Appl. No.: 14/904,617

(22) PCT Filed: Jun. 26, 2014

(86) PCT No.: PCT/EP2014/001733
§ 371 (c)(1),
(2) Date: Jan. 12, 2016

(87) PCT Pub. No.: WO2015/010761
PCT Pub. Date: Jan. 29, 2015

(65) Prior Publication Data

US 2016/0164190 A1 Jun. 9, 2016

(30) Foreign Application Priority Data

Jul. 24, 2013 (DE) ..... 10 2013 012 308

(51) Int. Cl.
*H01Q 13/10* (2006.01)
*H01Q 21/20* (2006.01)
(Continued)

(52) U.S. Cl.
CPC ..... *H01Q 21/205* (2013.01); *H01Q 9/40* (2013.01); *H01Q 13/085* (2013.01);
(Continued)

(58) Field of Classification Search
CPC .... H01Q 13/10; H01Q 21/205; H01Q 13/085; H01Q 13/106; H01Q 19/10
(Continued)

(56) References Cited

U.S. PATENT DOCUMENTS 2,515,344 A * 7/1950 Guanella ..... G01S 1/02 342/386
6,518,931 B1 2/2003 Sievenpiper
(Continued)

FOREIGN PATENT DOCUMENTS

DE 10 2010 011 867 12/2011
EP 1 695 416 6/2008
(Continued)

OTHER PUBLICATIONS

English translation of the International Preliminary Report on Patentability and Written Opinion of the International Searching Authority dated Feb. 4, 2016, issued in corresponding International Application No. PCT/EP2014/001733.
(Continued)

*Primary Examiner* — Dieu H Duong
(74) *Attorney, Agent, or Firm* — Nixon & Vanderhye P.C.

(57) ABSTRACT

The invention relates to an improved antenna which is distinguished by, among other things, the following features: the antenna has a monopole radiator (11), which is vertically polarized; the antenna has at least two horizontally polarized radiators, which lie offset from each other in a circumferential direction about a central axis (Z); the antenna has a reflector (1), in front of which the at least two horizontally polarized radiators and the monopole radiator (11) are arranged at a distance (A); the at least two horizontally polarized radiators each comprise a Vivaldi antenna (5); the Vivaldi antennas (5) have a central and/or feeding surface (123), which forms a feeding plane (123'), in which an
(Continued)

electrically conductive layer (27, 127) having slot lines (29') that widen in a radiation direction is formed or provided, —the feeding plane (123') is arranged at a distance (A) from the reflector (1); and the electrically conductive layer (27, 127) is led out of the feeding plane (123'), wherein at least one arcuate and/or bent extension (27*a*, 127*a*) is formed.

25 Claims, 9 Drawing Sheets

(51) Int. Cl.

| | |
|---|---|
| ***H01Q 9/40*** | (2006.01) |
| ***H01Q 13/08*** | (2006.01) |
| ***H01Q 21/24*** | (2006.01) |
| *H01Q 1/00* | (2006.01) |
| *H01Q 19/10* | (2006.01) |

(52) U.S. Cl.
CPC ..... *H01Q 13/106* (2013.01); *H01Q 21/24* (2013.01); *H01Q 1/007* (2013.01); *H01Q 19/10* (2013.01)

(58) Field of Classification Search
IPC ..... H01Q 13/10
See application file for complete search history.

(56) References Cited

U.S. PATENT DOCUMENTS

| | | | | |
|---|---|---|---|---|
| 7,271,775 | B1 | 9/2007 | Rossman et al. | |
| 7,623,868 | B2 * | 11/2009 | Judd ..... | H01Q 21/205 343/893 |
| 8,994,601 | B2 | 3/2015 | Hefele et al. | |
| 2003/0227351 | A1 | 12/2003 | Sievenpiper | |
| 2012/0075155 | A1 | 3/2012 | Lindmark et al. | |

FOREIGN PATENT DOCUMENTS

| | | |
|---|---|---|
| EP | 2 490 296 | 8/2012 |
| WO | WO 2011/157172 | 12/2011 |
| WO | WO 2012/101633 | 8/2012 |

OTHER PUBLICATIONS

International Search Report for PCT/EP2014/001733, dated Oct. 15, 2014, 3 pages.
Written Opinion of the PCT/EP2014/001733, dated, Oct. 15, 2014, 6 pages.

* cited by examiner

BROADBAND OMNIDIRECTIONAL ANTENNA

This application is the U.S. national phase of International Application No. PCT/EP2014/001733 filed 26 Jun. 2014, which designated the U.S. and claims priority to DE Patent Application No. 10 2013 012 308.9 filed 24 Jul. 2013, the entire contents of each of which are hereby incorporated by reference.

The invention relates to a broadband omnidirectional antenna in accordance with the preamble of claim 1.

Omnidirectional antennae are used for example as indoor antennae. They are multiband-capable and can radiate in a vertical and/or horizontal polarisation direction. In general, they are arranged in front of a ground plane or earth plane, which may for example be disc-shaped. The entire antenna arrangement is further arranged below a protective housing, in other words an antenna cover (radome).

An omnidirectional and vertically polarised antenna was known for example from EP 1 695 416 B1. The monopole radiator known therefrom rises vertically above a base plate or counterweight plane, from which it is galvanically separated. The vertically polarised monopole radiator thus comprises at least approximately a conical or frustum-shaped radiator portion (a diverging extension of which points away from the base plate or counterweight plane) and/or a cylindrical or cup-shaped radiator portion. Preferably, the conical or frustum-shaped radiator portion, the diverging extension of which points away from the counterweight plane, is initially attached to the counterweight plane and subsequently transitions into a tubular radiator portion. A preferred power supply is provided via a serial line coupling, which is formed in the central axis or axis of symmetry of the monopole radiator.

An omnidirectional indoor antenna which is comparable in this regard is known for example from EP 2 490 296 A1. It thus comprises a monopole radiator arrangement comparable with the prior art described above. By contrast with the initially described prior art, in EP 2 490 296 A1, instead of a disc-shaped reflector, a conical reflector arrangement which also converges conically in the direction of the monopole radiator is used.

A broadband, dual-polarised omnidirectional antenna arrangement is also known from WO 2012/101633 A1. It may for example be mounted in a room on a ceiling underside. A dipole arrangement, positioned mutually offset through 90° in each case, is provided in front of a reflector and results in a square structure when viewed from above. Centrally inside these dipole radiators, rising in front of a reflector at 90° in each case on the sides of a square, another electrically conductive monopole, orientated vertically to the reflector plane and rising with respect thereto, is provided as a vertically polarised radiator, which likewise, as in the prior art described at the outset, again comprises a cylindrical portion which is remote from the reflector and a conical portion which is closer to the reflector and tapers conically in the direction of the reflector.

An omnidirectional antenna arrangement is also known from WO 2011/157172 A2.

Finally, a generic omnidirectional and also dual-polarised antenna arrangement is disclosed and described in DE 10 2010 011 867 B4. This generic broadband, omnidirectional and also dual-polarised antenna further comprises, in addition to a monopole radiator which is vertically polarised, a dual-polarised radiator arrangement. The monopole is formed as a cylindrical radiator arrangement, in the cylinder casing of which, slots which are offset in the circumferential direction and each extend vertically are formed. Separate supply devices are provided for the monopole vertically polarised radiator, and also for the horizontally polarised radiator in the form of the slot antenna. In a preferred embodiment, the slots are excited using Vivaldi antennae. The Vivaldi antennae thus serve both as an independent horizontally polarised radiator element and as a supply device for the vertical slots, and this increases the bandwidth.

Proceeding from the aforementioned generic prior art, the object of the present invention is to provide a further-improved omnidirectional and also dual-polarised antenna.

The object is achieved according to the invention in accordance with the features set out in claim 1. Advantageous embodiments of the invention are set out in the dependent claims.

As a result of the present invention, a major further improvement over conventional omnidirectional antennae is achieved.

The omnidirectional antenna according to the invention is distinguished in that, as well as an overall reduced required installation space, it further has a much higher bandwidth. For example, the vertically polarised radiator can be used without difficulty in a frequency range from 790 MHz to 960 MHz and from 1710 MHz to 2700 MHz. The horizontally polarised radiator device may for example be operated in a frequency range from 1710 MHz to 2700 MHz. However, even these values are merely exemplary, since the antenna according to the invention is not limited to these frequency ranges.

The present omnidirectional antenna is further distinguished in that at least two Vivaldi antennae, which are mutually offset in the circumferential direction around a central axis, are arranged in front of a reflector plane, for example a disc-shaped planar reflector plane, at a distance therefrom. The monopole, vertically polarised radiator is subsequently positioned above the plane of these Vivaldi antennae.

Preferably, for horizontally polarised radiators, the antenna according to the invention comprises at least three or at least four Vivaldi antennae positioned relative to one another in the circumferential direction of the central axis. As is known, Vivaldi antennae are also referred to as tapered-slot antennae (TSAs), which are powered via a slot line. The actual antenna is a two-dimensional exponential horn, in which the slot-shaped structure progressing outwards from the supply point thus widens in the manner of a horn.

The Vivaldi antennae according to the invention are distinctive in that the slot which transitions into the exponential horn does not extend exclusively in a plane which is parallel to the reflector, but instead the remaining electrically conductive planes which define the slot and the exponential horn extend in an arc-shape or over graduations (bends) in the direction of the reflector.

As a result of this construction principle, it is possible for the waves propagating in the slot horn to be released from the conductive plane completely at the end of the slot. The conductive planes laterally delimiting the slot and the horn can therefore be extended as far as the reflector. These conductive planes of the Vivaldi antennae serve, simultaneously with the monopole, as a counterweight plane. The possibility of extending these conductive planes as far as the reflector further has the advantage that the counterweight plane of the monopole, which rises over the Vivaldi antennae, is enlarged. As a result, in turn, a larger bandwidth can be achieved. In addition, this simplifies the assembly of the Vivaldi radiators.

The monopole radiator may be of any suitable shape. Preferably, it is formed extending rotationally symmetrically around a central axis. Preferably, it is formed not just cylindrically, but at least slightly conically, in such a way that the outer surface thereof is formed diverging from the side facing the reflector or the Vivaldi antennae towards the open side thereof.

Likewise, it is possible to use monopoles which have a graduated or bent outer contour and transition from a more strongly diverging cone portion into a more weakly diverging cone portion. Further modifications may be implemented in this connection.

In principle, the shape of the monopole, the shape of the Vivaldi radiator and the distance from the reflector influence the radiation characteristic of the V-pole and H-pole radiator. Dual-polarised antennae are predominantly used for MIMO applications, in which as high a congruence as possible is generally required in the far field. The congruence in the vertical diagrams can be improved in this antenna by appropriately selecting the aforementioned parameters.

To summarise, it can thus be established that the most significant advantages of the solution according to the invention relate to the size reduction of the antenna arrangement, the cooperation and twofold use of the radiator elements, and the special shape of the horizontally polarised radiator. In the context of the invention, it is further possible to also increase the bandwidth of the vertically polarised radiator by extending the counterweight plane as far as the reflector.

In the following, the invention is described in greater detail by way of drawings, in which, in detail:

Figure 1:
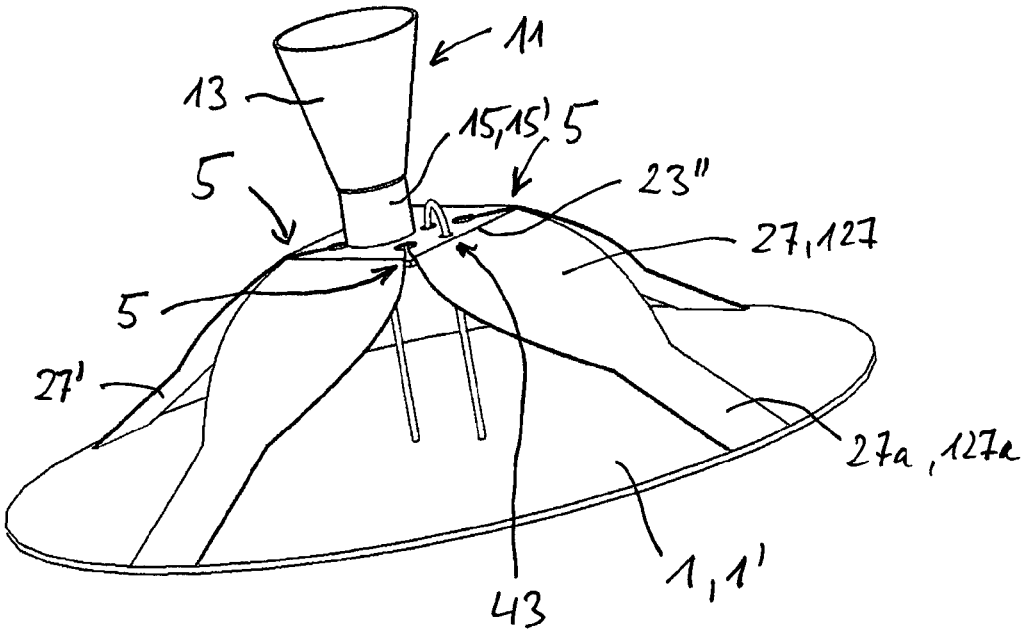
FIG. 1 is a three-dimensional view of the omnidirectional dual-polarised antenna according to the invention.
Figure 2:
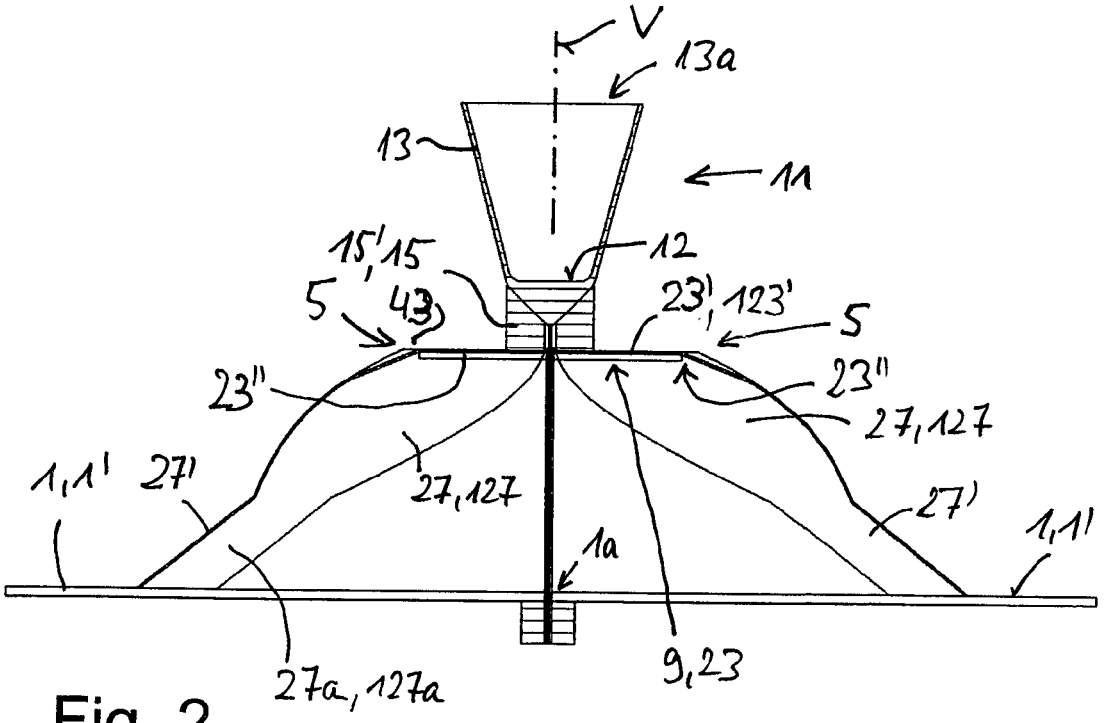
FIG. 2 is a side view of the embodiment of FIG. 1.
Figure 3A:
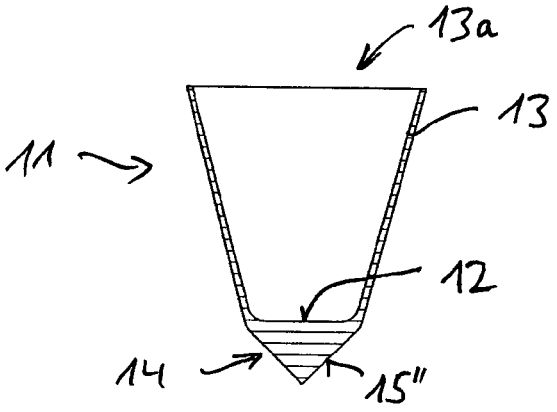
Figure 3B:
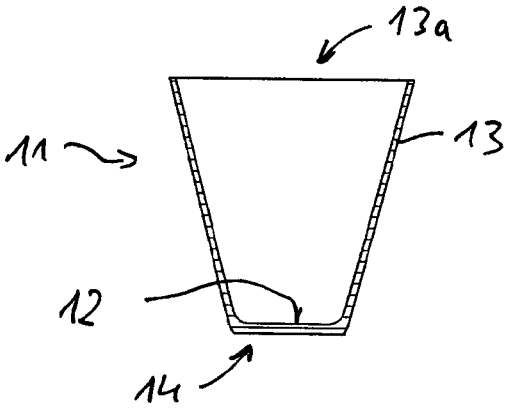
Figure 3C:
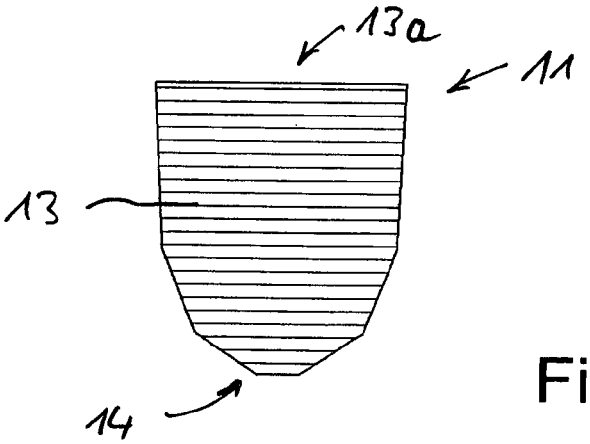
Figure 4:
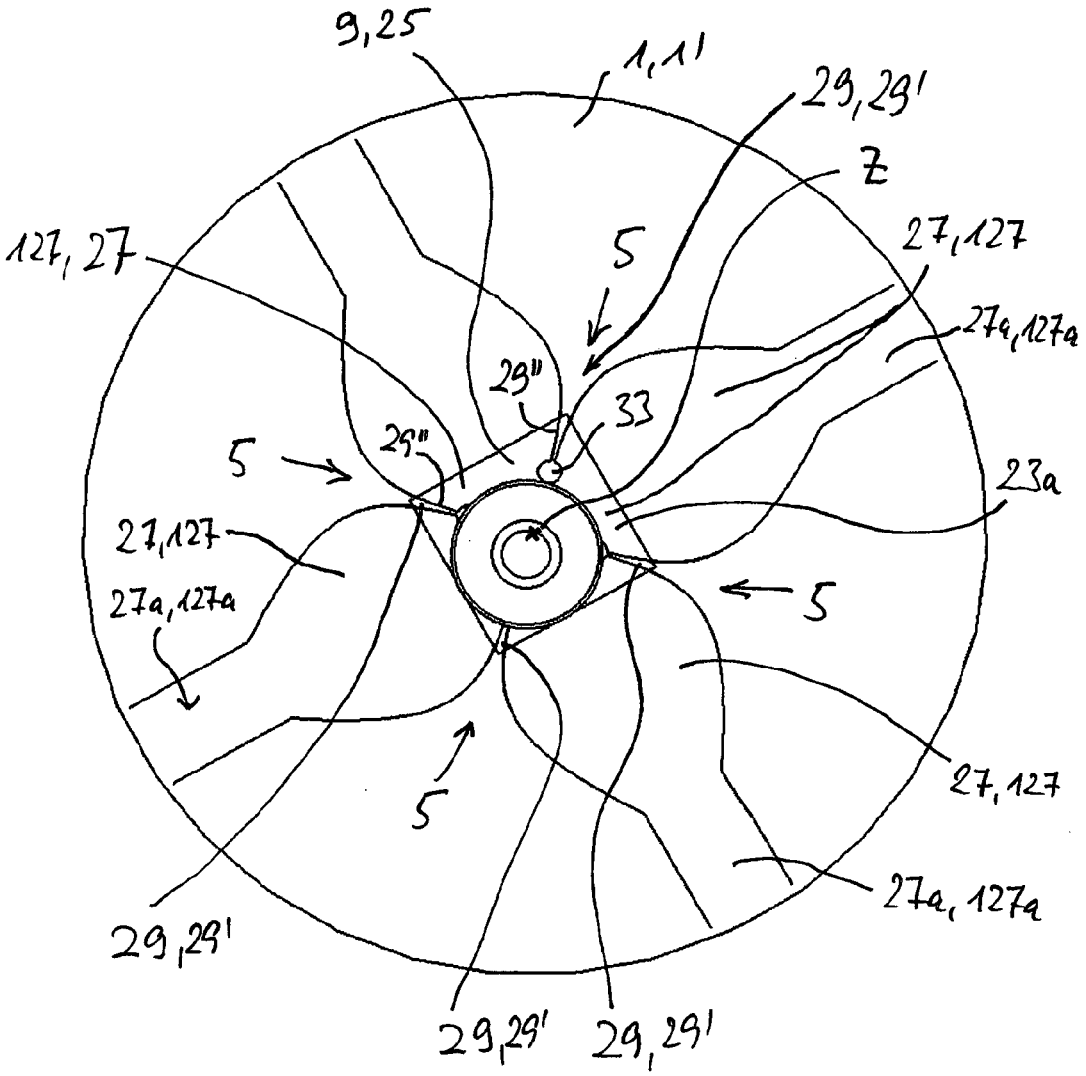
Figure 5A:
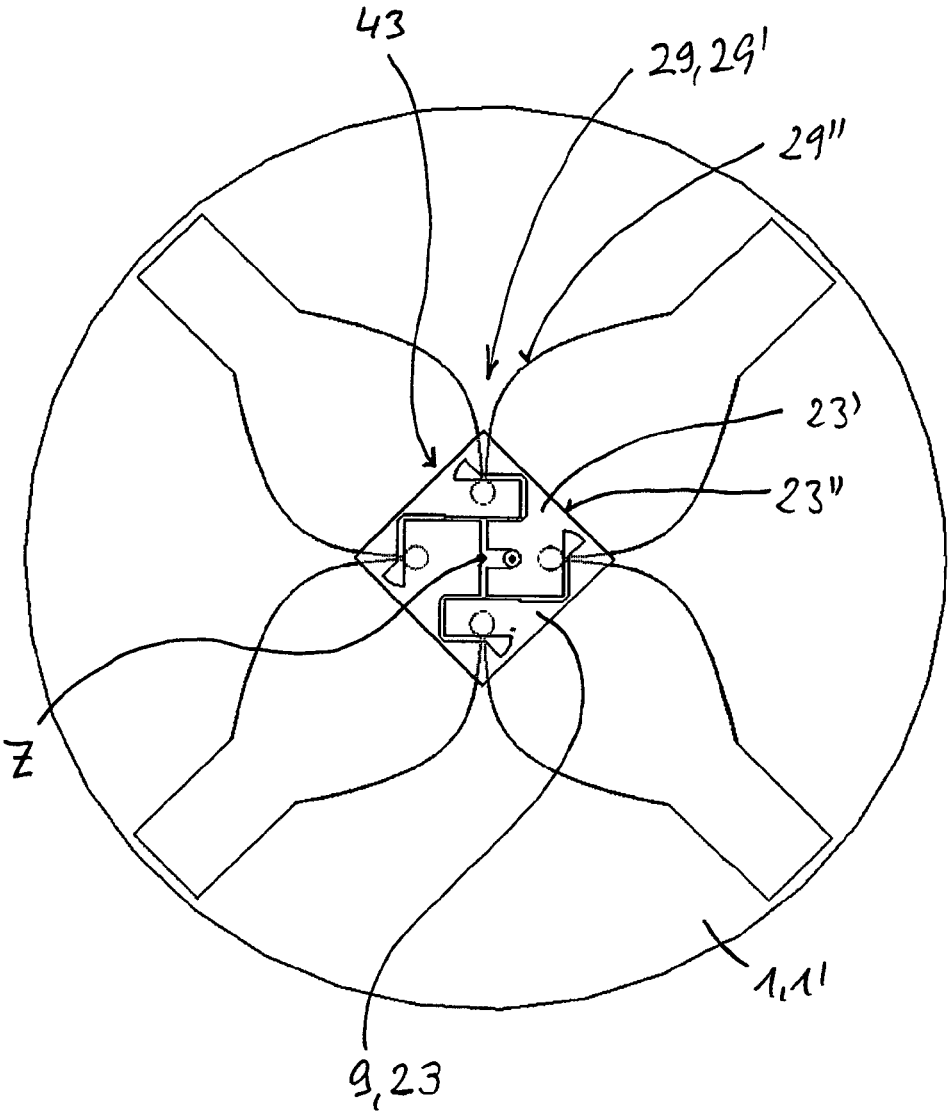
Figure 5B:
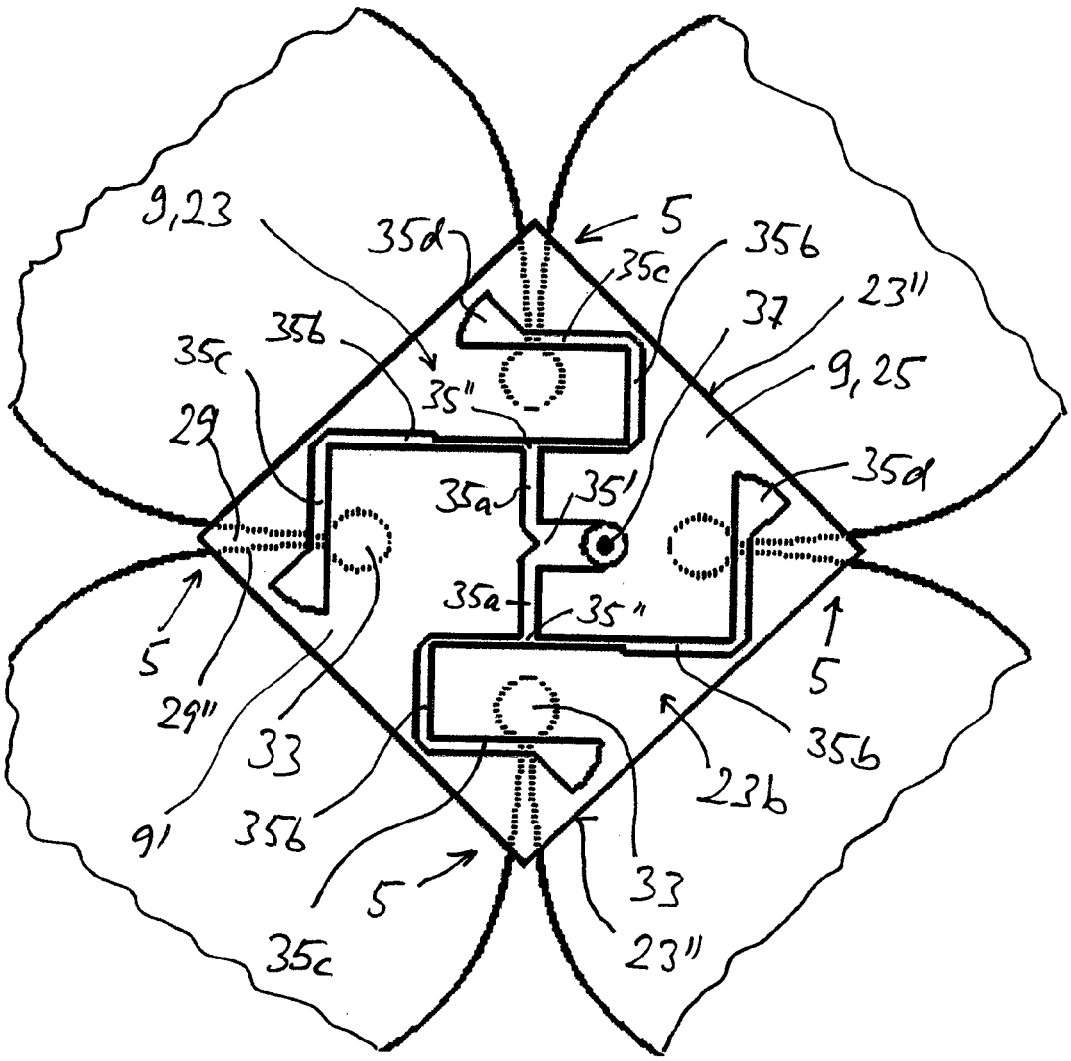

FIGS. 3*a* to 3*c* are three views of a monopole having a different shape;

FIG. 4 is a plan view of the antenna according to the invention shown in FIGS. 1 and 2;

FIG. 5*a* is a view of the antenna from below comprising a virtually see-through reflector;

FIG. 5*b* is an enlarged detail from FIG. 5*a;*

Figure 6:
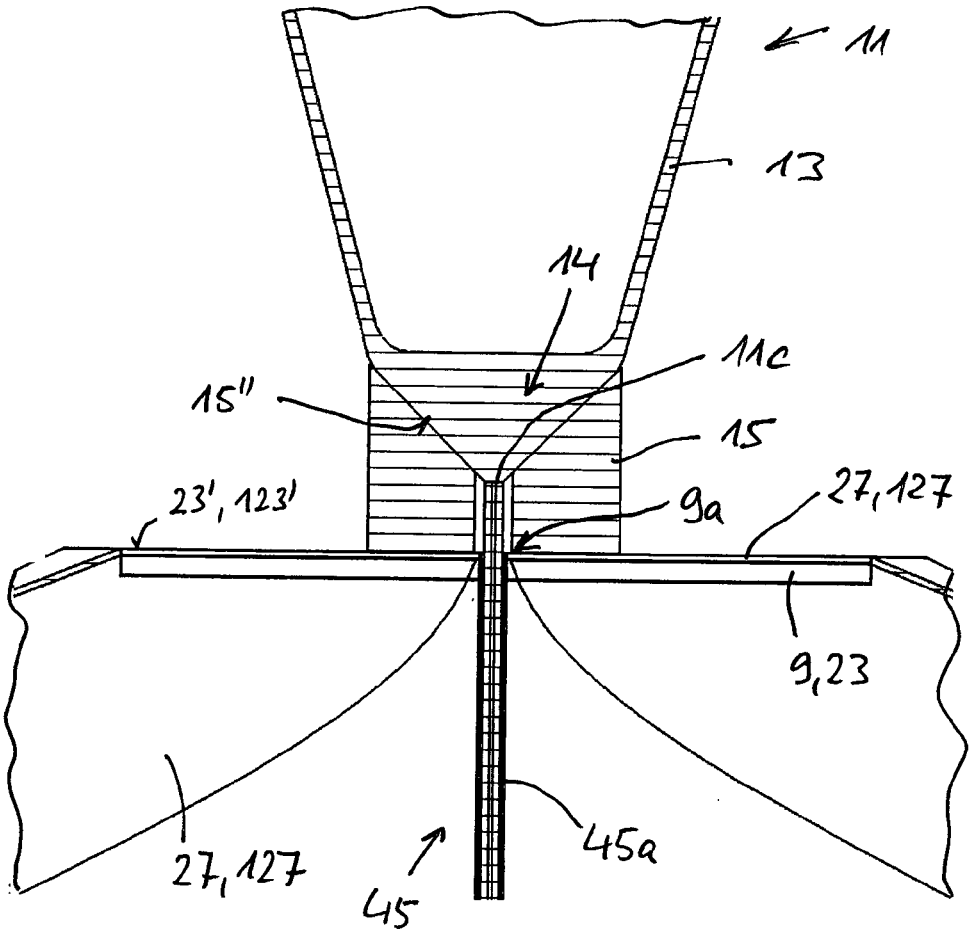
Figure 7:
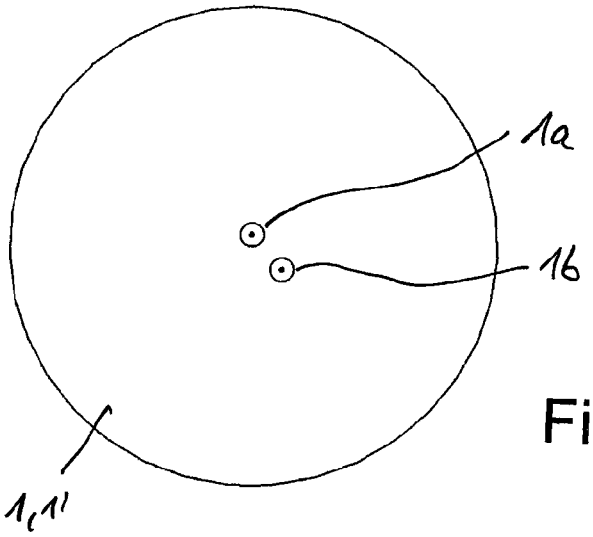
Figure 8:
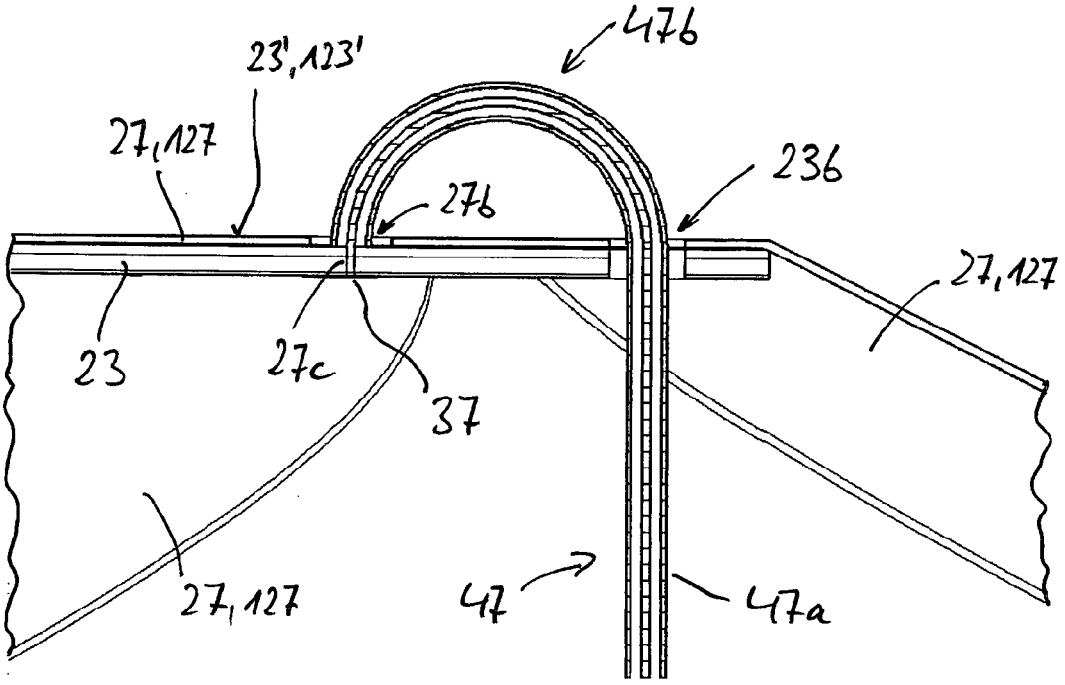
Figure 9:
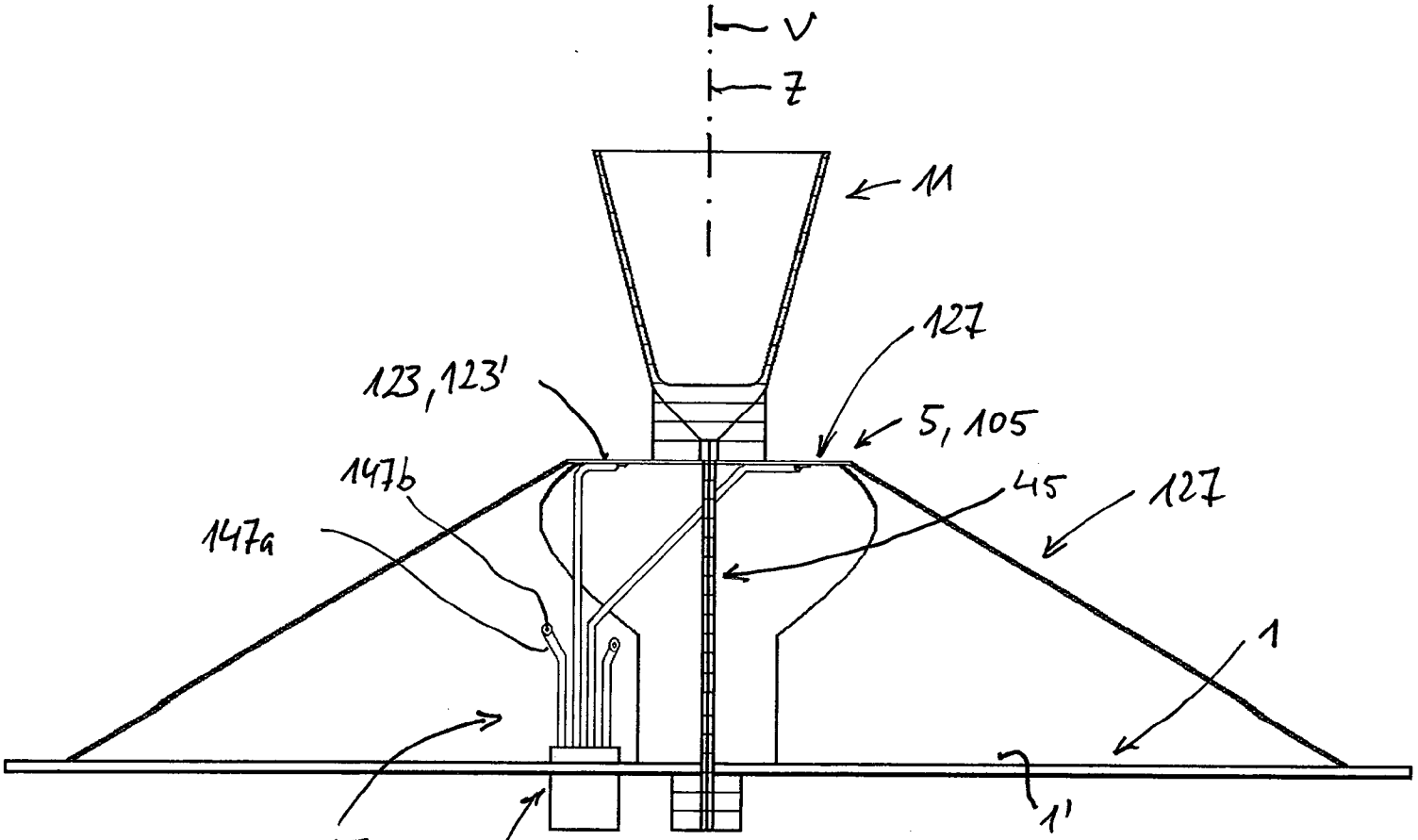
Figure 10:
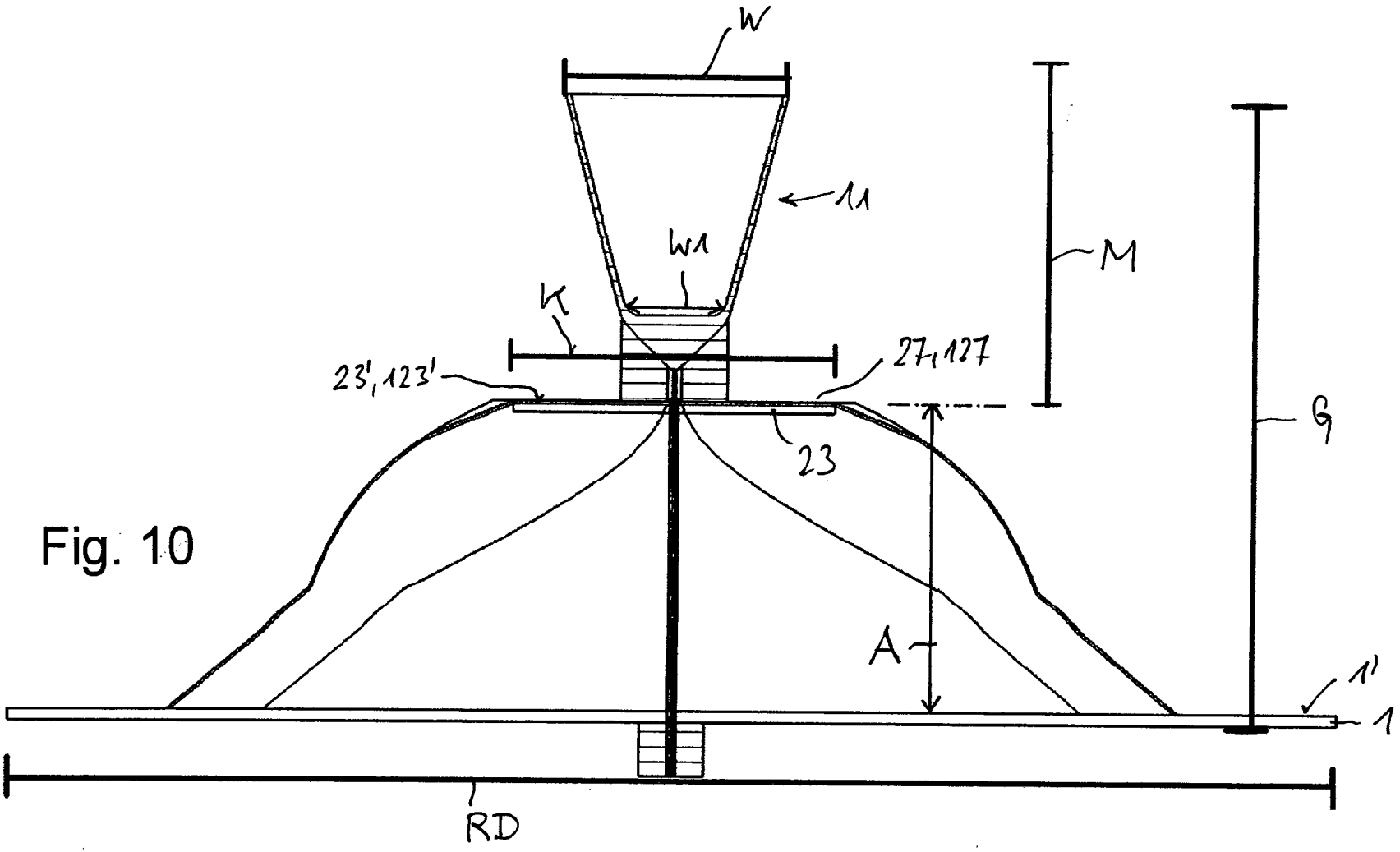

FIG. 6 is an axial sectional view through the monopole and the central portion of the Vivaldi antennae to illustrate the power supply to the monopole;

FIG. 7 is a plan view of the reflector, showing two clearances through which the supply lines for the vertically polarised radiator and the horizontally polarised radiator are passed;

FIG. 8 is a corresponding view to illustrate the power supply to the Vivaldi antennae;

FIG. 9 is a vertical sectional view, similar to FIG. 2, through the antenna, the horizontally polarised radiators consisting of a metal sheet and the slots, unlike in FIGS. 7 and 8, being powered via cables; and FIG. 10 is a view (side view) corresponding to FIG. 2, in which certain distances and heights are additionally shown, which serve to describe dimensional specifications for the described omnidirectional antenna.

FIG. 1 shows the omnidirectional dual-polarised antenna, specifically comprising a reflector 1, which is planar in the embodiment shown and has a disc-shaped, in other words circular structure in a plan view. The reflector 1 defines a reflector plane 1'.

In the embodiment shown, four Vivaldi antennae 5 are provided at a distance above the reflector plane 1', and are arranged equidistantly around a central axis Z (in FIGS. 4 and 5) extending perpendicular to the reflector plane 1'. In the embodiment shown, the four Vivaldi antennae 5 used are arranged around the central axis Z so as to be offset by 90° in each case. In the embodiment shown, the central axis Z is positioned centrally with respect to the reflector 1 and/or centrally with respect to the four Vivaldi antennae 5 and orientated so as to extend perpendicularly to the reflector plane 1'.

The Vivaldi antennae 5 are arranged at a distance A (FIG. 9) in a parallel orientation to the reflector plane 1'.

In the embodiment shown, the monopole radiator 11, sometimes also referred to in the following as a monopole or radiator monopole 11, is arranged above the Vivaldi antennae 5.

It is formed rotationally symmetrically around an axis positioned perpendicularly to the reflector plane 1'. This axis is also referred to in the following as a vertical axis V, which in the embodiment shown is also likewise perpendicular to the reflector plane 1'. As will also be seen in the following, the vertical axis V and the central axis Z are arranged in parallel but with a slight mutual lateral offset.

As can already be seen from the views according to FIGS. 1 and 2, although the monopole radiator may be configured cylindrically or as a hollow cylinder, in the embodiment shown it is formed conically or in the manner of a frustum. In this context, the radiator casing 13 is preferably formed so as to be widened conically from the assembly side or base region 14 thereof, facing the Vivaldi antennae, towards the open end 13*a*, which is remote from the reflector.

In FIG. 3*a*, the monopole radiator 11 previously shown in FIG. 2 is shown again separately in an axial section thereof. From this, it can be seen that the monopole radiator 11 is closed at the lower end thereof facing the Vivaldi antennae 5, specifically by a flat base 12. In the base region 14 thereof, the outer contour of the radiator monopole 11 is formed conically tapering even more strongly in the direction of the Vivaldi antennae, in other words in the manner of a cone.

This monopole radiator 11 may be held by means of a holding device 15, which may for example consist of a cylinder 15', the cylinder interior of which is for example adapted to the outer contour or the casing 15" of the monopole 11 in the base region 14 thereof, by means of which the monopole radiator 11 dips into the holding device 15. This holding device 15 is preferably not electrically conductive, and thus consists of a dielectric material. The aforementioned cylinder 15' is further positioned and held (at least indirectly) on the Vivaldi antennae.

FIG. 3*b* merely shows that the monopole radiator 11 may also have other cross-sectional shapes. In the variant of FIG. 3*b*, the lower base region 14 is also configured to be planar, in other words not only on the inside but also on the external underside thereof, resulting in a beaker shape widened upwards towards the opening. Any desired modifications are conceivable in this context, as is further shown by way of example in accordance with FIG. 3*c*, which provides a side view of a further modification of a monopole radiator 11. From this, it can be seen that the radiator casing 13 thereof may comprise a plurality of elbows at different heights in such a way that the conical or tapered shape can be formed, proceeding from the underside 14 of the monopole 11 to the opposite upper side 23*a*, which is open in the embodiment shown, by means of wall portions diverging at different angles.

In the following, the construction of the Vivaldi antennae 5 will be discussed.

FIG. 4 shows the upper side of the Vivaldi antennae and FIG. 5*a* shows the underside of the Vivaldi antennae. FIG. 5*b* is an enlarged detail from FIG. 5*a*.

As is known, Vivaldi antennae are what are known as tapered-slot antennae (TSAs), i.e. widened slot antennae. These are broadband antennae. They are often implemented on a substrate which is metallised on both sides.

In the embodiment shown, the Vivaldi antennae are powered by means of microstrip lines. A dielectric or substrate 23 is plate-shaped in the form of a printed circuit board 9. In a plan view, this substrate 23, dielectric 23 or printed circuit board 9 is of a square shape in the embodiment shown and is of a regular n-gon shape in general, n being a natural number>2. This is a regular n-gon. Therefore, in the case of three Vivaldi antennae arranged around the central axis Z, an equilateral triangle would be advantageous, in which the individual Vivaldi antennae are orientated so as to be mutually offset by 120° in each case. Four Vivaldi antennae would lead to the square shape, etc.

The substrate may consist of any suitable material. It is possible for the substrate to be formed from a plastics material body, for example. In this connection, the substrate itself may be more or less solid, in other words inflexible or substantially not flexible or deformable. However, it is also possible for the substrate to be formed from a flexible material, and therefore on the whole it is possible to refer to a flexible substrate. The conductive layers are thus located on this flexible substrate or in the form of coatings on the aforementioned plastics material body if this forms the substrate.

The upper face 23*a* of the aforementioned substrate 23, which is in the form of a printed circuit board 9, thus forms a supply plane 123' comprising a central and/or supply surface 123, which as described is preferably formed in the manner of a regular n-gon. The aforementioned Vivaldi antennae 5 are provided and formed in this central and/or supply surface 123.

In accordance with FIGS. 4, 5*a* and 5*b*, four Vivaldi antennae 5 are formed on this plate-shaped substrate 23, so as to be mutually offset at a 90° distance in the circumferential direction.

In the embodiment shown, the Vivaldi or Vivaldi-like antenna devices 5, in other words in general the tapered-slot antennae 5, comprise the aforementioned support material or substrate 23 (dielectric 23), in which for example a conductive layer 27, which comprises radial slot-shaped or groove-shaped clearances 29 which are mutually offset by 90° in the circumferential direction (see FIG. 4), is formed on the upper side 23*a* facing away from the counterweight plane or reflector plane 1, in other words on the side of the substrate 23 on which the monopole radiator 11 is also arranged. Each of the slot-shaped clearances 29 starts with a circular clearance 33 generally adjacent to the vicinity of the centre Z of the substrate 23, the slot-shaped structure 29, which widens outwards in a funnel shape and in the region of which the substrate 23 is freed from a conductive layer, proceeding in each case from the four circular clearances 33, which are likewise offset by 90° in the circumferential direction. As a result of this circular free space 33, the slot line 29' formed by the slot-shaped clearance 29 ends up being broadband, this circular free space 33 preferably being a quarter-wavelength long (with respect to an average operating wavelength). In the embodiment shown, the slot-shaped clearances 29, which widen outwards in a funnel shape, extend in the radial direction, in other words they are preferably symmetrical with a radial vector which extends through the centre Z (through which the central axis Z extends).

In FIG. 4, for at least some of the Vivaldi antennae in each case, the circular clearance 33 and the slot line 29' proceeding therefrom can be seen from the upper side, these clearances being enclosed by the conductive layer 27 formed on the upper side (in other words the side of the monopole radiator 11) on the substrate. However, what, if anything, can be seen from the upper side depends on the diameter of the cone and the distance of the start of the Vivaldi antennae from the central axis. They may also possibly be completely covered by the cone. In the views in FIGS. 5*a* and 5*b*, the circular clearances 33, which are not visible per se from the underside, and the slot-shaped structures 29 starting therefrom in the form of the slot line 29' are merely shown in dashed lines, since these structures are formed on the upper side facing the monopole radiator 11, and are not visible per se in the views from below in FIGS. 5*a* and 5*b*.

The edges 29" of the slot-shaped clearance (structure) 29, which define the slot lines 29', may be formed differently so as to adapt the bandwidth of the antenna. Preferably, these slot lines 29' are formed expanding outwards in a funnel shape, it being possible for the curve progression of the edges 29" which define the slot lines 29' to follow an exponential function.

The power supply to each slot line 29' is provided by a slot supply line 35 in each case, which proceeds in a seated manner from a supply point 37 (branch 37) in the centre Z of the substrate 23, through which the central axis and axis of symmetry Z pass. Proceeding therefrom, two slot supply lines 35*a* extend in opposite directions from a first branch point 35', starting with a radial line portion 35*a*, followed in the embodiment shown, at a further branch point 35", by two line portions 35*b*, each perpendicular to said radial line portion and extending in opposite directions, so as subsequently to transition into a third line portion 35*c*, which is again at a right angle and transversely and preferably perpendicularly intersects the relevant slot line 29'. Other, for example arcuate progressions of the supply lines 35 are also possible. What is essential is that they start from a supply point and cross the slot line 29.

To improve the bandwidth of these Vivaldi antennae 5, it is provided that the slot lines 35, in the form of strip lines on the substrate 23, are finished with a corresponding surface element 35*d*, which may be in the shape of a triangle or a circle sector or the like (FIG. 5*b*).

The respective multiple elbows in the supply slot lines 35 may be provided each extending in the same direction in the circumferential direction such that, proceeding in the circumferential direction, a following slot line portion 35*b* etc. follows each radial line portion 35*a* in the same direction, whereas, in the embodiment shown, two supply line portions extending in opposite directions proceed from the crossover point 35 in each case, and subsequently each branch again at a subsequent branch point 35" into further line portions in each case, which cross the slot lines for the power supply.

The aforementioned slot supply lines 35 are formed on the underside 23*b* of the substrate 23, in other words facing the reflector 1, the slot lines 29' formed on the opposite, upper side 23*a* of the substrate 23 being shown in dashed lines in FIGS. 5*a* and 5*b*.

The peculiarity in the embodiment shown is merely that the slot-shaped structure 29, which widens in a funnel shape from the inside to the outside, does not carry on continuously in a plane corresponding to the substrate plane 23' as far as an end, but instead the conductive layer 27, which may also be in the form of a metal sheet 127, is extended over the delimiting edges 23" (longitudinal and transverse faces) of the printed circuit board 9, in other words beyond the substrate 23, and thus now extends in the direction of the reflector 1 over arcuate and/or over bend points 43, optionally at a different angle of inclination, as can be seen for example from FIG. 1 or FIG. 2. However, the slot width, in other words the width of the slot line 29' which widens in a funnel shape, is also maintained in the transition region, where the conductive layer 27 or the electrically conductive metal sheet 127 leaves the printed circuit board plane 9'. In other words, in this case the slots also constantly and continuously become wider, and the slot width is not widened discontinuously as a result of the formation of corners or graduations. The exponential shape from the plane is in effect "projected" onto the metal sheet. In a plan view of the antenna, a continuous exponential curve can be seen. The formation may also be such that the conductive layer or surface 27 on the substrate 23 is formed, at the latest, at the transition into the outwardly extending extension 27*a*, for example in the form of a metal sheet extension 127*a*. In other words, the conductive layer 27 may be formed on the substrate as a conductive layer in the region of the substrate, subsequently, upon leaving the substrate 23, transitioning into a metal sheet 127, in the manner of a metal sheet extension 127*a*, of sufficient rigidity and load-bearing capacity. Otherwise, however, a support structure may also be provided here in the region of the extension 27*a* for example using a dielectric, on which the electrically conductive layer 27 is formed over the central and/or supply plane 123, in other words beyond the central or supply region 123, as an electrically conductive layer.

As can be seen from the drawings, the slot-shaped clearances 29 and thus the slot line 29' become wider more and more rapidly after leaving the substrate 23.

Since, as described, the conductive plane or the conductive layer 27, which as stated may be in the form of a conductive metal sheet 127, extends downwards, in other words inclined in the direction of the reflector 1, the electromagnetic waves propagated over the slots 29 may (at the latest) start to be released from the conductive plane 27, 127 at the end of the slot (at the level of the substrate 23). Specifically, however, the electromagnetic waves are already released before they reach the metal sheet. The point at which they are released is frequency-dependent, and depends on the slot width of the point in question. This is because a Vivaldi antenna, as conventionally used, is a tapered-slot antenna having a coplanar structure, in which an electrically conductive structure is applied to a dielectric 23 on either side, causing emission of the electromagnetic waves in a direction parallel to the plane of the dielectric. In the embodiment shown, too, the electromagnetic waves propagate in the respective slot-shaped structures 29 in the substrate plane 23' (also referred to as the supply plane 123'), these electromagnetic waves subsequently being released, and having to be released, from the conductive planes 27, 127 since the electrically conductive planes 27 defining the slot-shaped structures 29 pass out of the substrate plane or supply plane 23', 123' and are orientated or guided away so as to extend in the direction of the reflector 1. As stated previously, the release of the electromagnetic waves is frequency-dependent. The largest slot width at the end of the metal sheet thus determines the lower boundary frequency. Thus, by this point, all of the desired frequencies have been released from the radiator. Since the electromagnetic waves are thus ultimately fully released from the conductive plane 27, because, as stated, this conductive plane 27 is increasingly distanced further away from the printed circuit board plane 9', in other words the substrate plane or supply plane 23', 123', in the direction of the reflector plane 1', it is possible to provide this conductive plane 27 or the conductive metal sheet 127 by way of an extension 27*a* or 127*a* which is extended as far as the reflector 1. In other words, at the end, the conductive layer or the conductive metal sheet can be mechanically connected directly to the reflector, and is optionally even galvanically attached there. This additionally has the further advantage that the counterweight plane of the monopole 11 is enlarged as a result. The monopole radiator 11 thus has a larger bandwidth. Furthermore, this simplifies the assembly of the Vivaldi radiator.

Depending on the geometric shape of the conductive plane 27 having the radial widening 27*a* or the shape of the conductive metal sheet 127 having a corresponding widening 127*a*, which thus simultaneously forms the counterweight plane for the monopole radiator 11, the monopole radiator 11 may be shaped accordingly, in other words be shaped differently. As a result of the sloping flanks of the conducting plane 27, it is advantageous for the monopole radiator 11 accordingly to widen conically from the lower supply and anchoring point thereof to the open end 13*a* thereof which is remote from the reflector, so that the outer surface 13 is orientated outside the substrate 9 approximately perpendicularly to the inclined plane 27' of the conducting layer 27 in the extension direction or deviates less from a perpendicular. This shaping is therefore also desirable and preferred so as to achieve as high a congruence as possible of the radiation patterns of the V-pole and H-pole radiators.

FIGS. 6, 7 and 8 show further feeds to the antenna which are also possible.

In FIG. 6, it can be seen that the feed 45 for the monopole radiator 11 comprises a coaxial cable 45*a*, which extends through a hole 1*a* in the reflector 1 (FIG. 7), proceeding from the rear face of the reflector 1, it being possible for the hole 1*a* to be arranged in the axial extension of the vertical axis V, which forms the axis of rotation of the monopole radiator. In other words, the coaxial line 45*a* thus extends through the hole 1*a* in the reflector 1 and for example a subsequent path extending perpendicular to the reflector plane 1', and subsequently passes through a further hole 9*a* in the printed circuit board 9/substrate 23 and in the conductive layer 27. From there, the coaxial line passes in an axial extension, in other words continuing in a straight line, as far as the lower supply point 11*c* on the monopole radiator 11. There, the internal conductor of the coaxial cable is connected, generally soldered, to the electrically conductive monopole radiator 11 at the supply point 11*a*. The monopole radiator 11 may consist of electrically conductive material or of a dielectric material, which is subsequently coated with an electrically conductive layer. The external conductor of the coaxial cable 45*a* is connected to the earth plane of the circuit board of the Vivaldi radiators, in other words to the conductive layer 27 or to the electrically conductive metal sheet 127.

In this case, the feed 47 for the Vivaldi radiators is provided, merely by way of example, by a coaxial line 47*a* which passes through a second hole 1*b*, proceeding from the rear face of the reflector 1, this second hole 1*b* being positioned so as to be offset from the central axis Z, i.e. from the centre point of the disc-shaped reflector arrangement, in other words at least slightly offset, as can be seen in FIG. 7. From there, the coaxial cable is passed onwards in a perpendicular extension with respect to the reflector plane 1' in the direction of the substrate 23, where the coaxial cable 47*a* passes through the substrate 23 and the layer 27 eccentrically in a second hole 23*b* (see FIG. 7), so as subsequently to be passed back in the direction of the substrate 23 above the conductive layer 27 by way of an arcuate return 47*b*. The cable should be guided such that it rests as tightly as possible against the conductive layer so as not to influence the radiation characteristic of V-pole radiators. Since the slot supply line 35 is provided below the printed circuit board/substrate (in other words facing the reflector 1), in other words below the conductive layer 27 forming the earth plane, so as to prevent interference due to the conical monopole radiator 11, the coaxial supply cable 47*a* is passed, by the attachment end thereof, through a hole 27*b* in the electrically conductive layer 27 or in the electrically conductive metal sheet 127 and a hole 27*c* coaxial therewith in the printed circuit board, in other words the substrate, from above, in other words the internal conductor is passed through here so as to solder the internal conductor to the branch point 37, which thus forms the feed point, of the Vivaldi antennae 5 from above. The external conductor is in turn galvanically connected, generally soldered, to the earth plane, in other words the conductive layer 27 (metal sheet 127). Since the cable guidance below the Vivaldi radiator barely influences the antenna characteristic, because this region is virtually field-free, this simplified connection situation does not lead to a disadvantageous change in the radiation characteristic of the omnidirectional dual-polarised antenna.

However, the coaxial cable, in other words the supply line 45 or the coaxial cable 45*a* for the monopole 11 but also for the supply line 47 comprising the coaxial cable 47*a* for the Vivaldi antennae 5, may also be laid otherwise than in the described manner.

The following refers to FIG. 9, in which the previously described Vivaldi antennae 5 are formed from a metal sheet 127, in other words without the substrate or dielectric 23 mentioned in the previous embodiments. All of the Vivaldi antennae 5 of a corresponding antenna arrangement may thus consist of a shared metal sheet 127, from which the entire arrangement is punched out and brought into the desired shape by trimming and/or bending (deformation in general). The layer 27 described by way of the previous embodiments (formed on the upper side 23*a* of the substrate 23 in the other embodiments) is thus part of the metal sheet 127 in the variant of FIG. 9.

The monopole 11 shown and the associated supply line or coaxial line 45 is formed, and can also be formed in this embodiment according to FIG. 9, as was described by way of the previous embodiments. However, unlike in the previous embodiments, the Vivaldi antennae may be powered not via micro-lines but by means of coaxial cables 147, which can extend and be combined for example in the field-free space between the metal sheet 127 of the Vivaldi antennae 5 and the reflector 1, in other words the coaxial cables 147 extend in particular in the field-free space between the reflector 1 and the central and/or supply plane 123, which in this embodiment likewise consists of a metal sheet 127.

Thus, in this embodiment according to FIG. 9, a shared supply opening or supply input 109 is provided at a corresponding through-hole in the reflector 1, through which a corresponding number of coaxial cables 147 are passed, the external conductors 147*a* in the supply plane 123' being (galvanically) connected to the Vivaldi antennae formed from a metal sheet 127, and the internal conductors 147*b* (similarly to in the previous embodiments) leading to the supply lines 35 or serving as supply lines 35 and being formed accordingly, and thus crossing, preferably perpendicularly crossing, the clearances 29 in the form of the slot lines 29' for the power supply in the associated Vivaldi antennae, and extending in parallel with the supply plane 123' in doing so. Therefore, in the embodiment shown, when four Vivaldi antennae are used, four coaxial cables 147 are provided.

The following refers to FIG. 10, which provides a view corresponding to FIG. 2.

From this, it can thus be seen that the power supply to the Vivaldi antennae 5, in other words the Vivaldi radiators, may also be provided in another manner than by microstrip lines. As described, it is also possible to supply each slot line 35 using a cable, which is connected to the internal conductor of the associated coaxial cable 147 or consists of the internal conductor 147*b* of the associated coaxial cable 147, it thus being possible to interconnect the individual coaxial cables 147 at a different point, for example in the field-free space between the reflector and the metal sheet. In the embodiment shown, they are interconnected in the region of the passage 109 or even below the reflector 1. As a result, it is thus possible for the Vivaldi radiators to be made completely from sheet metal. A circuit board is not strictly necessary in this case. If the Vivaldi radiators are thus made completely from a metal sheet, in other words a metal sheet 127, what is known as a substrate plane 23' is no longer provided either, since the substrate 23 itself is actually omitted. Therefore, the plane referred to in the previous embodiments as the substrate plane 23' is also referred to as a supply plane 123'.

In the described embodiment according to FIG. 9, it is thus also possible to position the vertically polarised radiator, in other words the monopole radiator 11, centrally on the metal sheet 127 in the central and/or supply plane 123 so that the central axis Z and the vertical axis V coincide, as can be seen from FIG. 9.

From this, it can be seen that for example the substrate 23 or the electrically conductive plane 27 located thereon is arranged at a distance A from the reflector plane 1', it being possible for this distance A to be for example between 30 mm and 60 mm, in particular between 35 mm and 55 mm or between 40 mm and 50 mm. Values around 45 mm appear to be suitable.

The total height G of the entire dual-polarised omnidirectional antenna may for example be greater than 50 mm, in particular greater than 55 mm, 60 mm, 65 mm, 70 mm, 75 mm, 80 mm, 85 mm, 90 mm, 95 mm or 100 mm. The antenna according to the invention may however be of a very compact construction and in particular have a total height G which is less than 120 mm, in particular less than 115 mm, 110 mm, 105 mm, 100 mm, 95 mm or 90 mm.

The actual height M of the monopole radiator 11 above the electrically conductive layer 27, 127 and thus above the substrate 23 may vary for example between 20 and 60 mm, in particular be greater than 25 mm, 30 mm, 35 mm, 40 mm or 45 mm. However, this height is preferably less than 55 mm, 50 mm, 45 mm or for example 40 mm.

The opening width W of the monopole radiator 11 may for example be less than 60 mm, in particular less than 55 mm, 50 mm, 45 mm or 40 mm, and in particular 35 mm. Values greater than 20 mm, in particular 25 mm, 30 mm or 35 mm have proven to be favourable. Meanwhile, the opening width W may be between 75% and 125% of the width W1 in the base region 12, 14, in particular may fluctuate between 80% and 120%, 85% and 115% or 90% and 110% or 95% and 105%, in particular be approximately twice as large as the width W1 in the base region.

In the embodiment shown, the length K, in other words the edge length 23' of the substrate 23, in other words of the printed circuit board 9, may preferably vary between 30 mm and 70 mm, and thus preferably be greater than 35 mm, 40 mm or 45 mm.

On the other hand, to provide a compact antenna size, this edge length should be less than 65 mm, 60 mm or 55 mm. Values around 50 mm have proven to be favourable.

Taking into account the above data, it is possible for example to use a circular reflector 1, the external diameter RD of which is greater than 200 mm, in particular greater than 210 mm, 220 mm, 230 mm or 240 mm. In particular, however, in the context of the invention a compact antenna can provided in which the diameter of the reflector 1 is less than 350 mm, in particular less than 330 mm, 310 mm, 300 mm, 290 mm, 280 mm, 270 mm and in particular less than 260 mm. Values around 250 mm are possible.

The invention claimed is:

1. Broadband omnidirectional antenna comprising:

a monopole radiator which is vertically polarised, at least two horizontally polarised radiators which are positioned around a central axis so as to be mutually offset in the circumferential direction, a reflector, in front of which the at least two horizontally polarised radiators and the monopole radiator are arranged at a distance, the at least two horizontally polarised radiators each comprising a Vivaldi antenna, the Vivaldi antennae comprising a central and/or supply surface, which forms a supply plane in which an electrically conductive layer having slot lines which widen in the radiation direction is formed or provided, the supply plane being arranged at a distance from the reflector, and the electrically conductive layer being guided out of the supply plane, at least by a component in the direction of the reflector, so as to form at least one arcuate and/or bent extension.

2. Antenna according to claim 1, wherein the electrically conductive layer is formed on the upper side of a substrate facing the monopole.

3. Antenna according to claim 2, wherein the extensions, guided out beyond the central and/or supply surface and thus the supply plane, are in the form of a metal sheet.

4. Antenna according to claim 2, wherein the central and/or supply surface having the electrically conductive layer is formed on the upper side of the substrate.

5. Antenna according to claim 1, wherein the Vivaldi antennae in the central and/or supply surface and the extensions projecting therebeyond are formed as a whole from a metal sheet or comprise a metal sheet.

6. Antenna according to claim 1, wherein the electrically conductive layer defining the slot lines and the extensions proceeding therefrom lead as far as the reflector and are connected both mechanically rigidly and electrogalvanically to the reflector.

7. Antenna according to claim 1, wherein the central and/or supply surface has a regular n-gon shape in a vertical plan view, n being a number>2 and n corresponding to the number of Vivaldi antennae.

8. Antenna according to claim 1, wherein the monopole radiator is arranged and/or held directly or at least indirectly on the central and/or supply surface, which is formed from the electrically conductive layer on the upper side of the substrate or from a metal sheet.

9. Antenna according to claim 8, wherein the monopole radiator is arranged on the central and/or supply surface at least indirectly by means of an electrically non-conductive and/or dielectric holding device.

10. Antenna according to claim 8, wherein the monopole radiator is rotationally symmetrical.

11. Antenna according to claim 8, wherein, progressing away from the reflector or from the substrate, the monopole radiator is widened conically or has conically widened portions.

12. Antenna according to claim 11, wherein, proceeding from the mounting side thereof facing the substrate to the free end thereof, the monopole radiator comprises successive conical portions having a different angle of inclination.

13. Antenna according to claim 1, wherein the monopole radiator comprises a radiator casing and is hollow in the internal region of the radiator casing proceeding from the side thereof opposite the mounting side.

14. Antenna according to claim 1, wherein the slot-shaped structure of the Vivaldi antennae is formed on the side of the substrate facing the monopole radiator.

15. Antenna according to claim 1, wherein the slot supply lines are formed on the side of the substrate facing the reflector.

16. Antenna according to claim 1, wherein the slot lines each proceed from a circular free space.

17. Antenna according to claim 1, wherein the widened slot lines of the Vivaldi antennae start in the central and/or supply surface and pass through air after leaving this central and/or supply surface and after leaving the substrate.

18. Antenna according to claim 1, wherein the Vivaldi antennae are arranged around a central axis so as to be mutually offset at equal distances in the circumferential direction, passing centrally through the substrate, and in that the vertical axis, which is parallel to the central axis, of the monopole radiator is arranged eccentrically offset from said central axis.

19. Antenna according to claim 1, wherein the monopole radiator is powered via a coaxial supply line, the internal conductor of which is connected to the underside of the monopole radiator and the external conductor of which is electrogalvanically connected to electrically conductive surfaces on the substrate.

20. Antenna according to claim 1, wherein a coaxial supply line for the Vivaldi antennae is passed via an eccentric hole in the substrate onto the upper side of the substrate and via an arcuate return and a further hole in the printed circuit board, whereby the internal conductor is electrogalvanically connected to the slot supply lines on the underside of the substrate and the external conductor is electrogalvanically connected to the electrically conductive layer on the upper side of the substrate.

21. Antenna according to claim 1, wherein coaxial supply lines are provided for the Vivaldi antennae and pass through air in the region between the reflector and the central region surface and/or supply region surface, the associated internal conductors of these coaxial cables being electrically connected or coupled to the relevant slot supply line of an associated Vivaldi antenna or forming the associated slot supply line.

22. Antenna according to claim 21, wherein the coaxial cables providing the power supply to the Vivaldi antennae are brought together or interconnected on the side of the reflector facing away from the monopole radiator.

23. Antenna according to claim 1, wherein, in a plan view of the antenna, the edges delimiting the slot lines of the Vivaldi antennae form a continuous, exponential curve, in the region in which the electrically conductive layer leaves the central and/or supply surface, in the form of the upper side of the substrate, and transitions into the extensions.

24. Antenna according to claim 1, wherein at least portions of the extensions and in particular over 75% of the length thereof, pass out of the supply plane in the direction of the reflector in an angular range of more than 10°, and less than 80°.

25. Antenna according to claim 24, wherein the conductive layer is located on a flexible substrate and/or the conductive layer is formed as a coating on a substrate which consists of or comprises a plastics material body.

* * * * *